US011165154B2

(12) United States Patent
Suzuki et al.

(10) Patent No.: US 11,165,154 B2
(45) Date of Patent: Nov. 2, 2021

(54) COIL ANTENNA

(71) Applicant: Murata Manufacturing Co., Ltd., Nagaokakyo (JP)

(72) Inventors: Yusuke Suzuki, Nagaokakyo (JP); Kenji Naito, Nagaokakyo (JP); Minoru Sunahara, Nagaokakyo (JP)

(73) Assignee: MURATA MANUFACTURING CO., LTD., Nagaokakyo (JP)

( * ) Notice: Subject to any disclaimer, the term of this patent is extended or adjusted under 35 U.S.C. 154(b) by 366 days.

(21) Appl. No.: 16/197,824

(22) Filed: Nov. 21, 2018

(65) Prior Publication Data

US 2019/0097322 A1 Mar. 28, 2019

Related U.S. Application Data

(63) Continuation of application No. PCT/JP2017/018594, filed on May 17, 2017.

(30) Foreign Application Priority Data

Jun. 3, 2016 (JP) ..... JP2016-112134

(51) Int. Cl.
*H01Q 7/08* (2006.01)
*H01Q 1/08* (2006.01)
*H01Q 1/32* (2006.01)

(52) U.S. Cl.
CPC ..... *H01Q 7/08* (2013.01); *H01Q 1/085* (2013.01); *H01Q 1/3241* (2013.01)

(58) Field of Classification Search
CPC ..... H01Q 1/3241; H01Q 7/08; H01Q 1/085
See application file for complete search history.

(56) References Cited

U.S. PATENT DOCUMENTS 6,400,338 B1 6/2002 Mejia et al.
6,947,004 B2 9/2005 Mejia et al.
7,095,381 B2 8/2006 Kimura et al.
(Continued)

FOREIGN PATENT DOCUMENTS

JP 2003520475 A 7/2003
JP 2005295473 A 10/2005
(Continued)

OTHER PUBLICATIONS

International Search Report issued for PCT/JP2017/018594, dated Jul. 18, 2017.
(Continued)

*Primary Examiner* — Dameon E Levi
*Assistant Examiner* — Jennifer F Hu
(74) *Attorney, Agent, or Firm* — Arent Fox LLP

(57) ABSTRACT

A coil antenna having a capacitor that is not separated from a metal terminal or an electrode of a mounting substrate even when a root portion of a bobbin around which a coil is wound is bent by an external force. The coil antenna includes a bobbin; a coil wound around the bobbin; a capacitor connected to the coil; a base made of an insulating material formed integrally with the bobbin; and a mounting substrate having a plate shape with a pair of electrodes formed on a surface of the mounting substrate extended from the base for mounting the capacitor, such that the mounting substrate is held in a cantilevered manner in a winding direction of the coil.

12 Claims, 8 Drawing Sheets

(56) References Cited

U.S. PATENT DOCUMENTS

| | | | | |
|---|---|---|---|---|
| 8,754,823 | B2 | 6/2014 | Ohara | |
| 9,437,927 | B2 | 9/2016 | Koga et al. | |
| 9,768,509 | B2 | 9/2017 | Tanaka et al. | |
| 10,141,649 | B2 | 11/2018 | Miura et al. | |
| 10,186,764 | B2 * | 1/2019 | Kikuchi | H01Q 1/3241 |
| 10,186,774 | B2 * | 1/2019 | Tanaka | H01Q 7/08 |
| 2002/0154065 | A1 | 10/2002 | Mejia et al. | |
| 2003/0231020 | A1 | 12/2003 | Yonezawa et al. | |
| 2005/0219139 | A1 | 10/2005 | Kimura et al. | |
| 2007/0091007 | A1 * | 4/2007 | Sako | H01Q 7/08 343/788 |
| 2007/0139288 | A1 * | 6/2007 | Shigemoto | H01Q 7/08 343/788 |
| 2011/0215987 | A1 * | 9/2011 | Ohara | H01Q 1/50 343/906 |
| 2011/0241957 | A1 * | 10/2011 | Ohara | H01Q 1/3241 343/788 |
| 2012/0176215 | A1 * | 7/2012 | Kudo | H01Q 1/40 336/221 |
| 2015/0042529 | A1 * | 2/2015 | Tanaka | H01Q 7/00 343/788 |
| 2015/0116171 | A1 | 4/2015 | Koga et al. | |
| 2015/0295315 | A1 * | 10/2015 | Tanaka | H01Q 7/08 343/788 |
| 2016/0093954 | A1 * | 3/2016 | Tabata | H01F 5/04 343/788 |
| 2016/0315389 | A1 | 10/2016 | Imai et al. | |
| 2017/0104272 | A1 | 4/2017 | Miura et al. | |
| 2017/0155188 | A1 * | 6/2017 | Kikuchi | H01Q 1/3241 |

FOREIGN PATENT DOCUMENTS

| | | | |
|---|---|---|---|
| JP | 2010213234 | A | 9/2010 |
| JP | 2011211578 | A | 10/2011 |
| JP | 2013225947 | A | 10/2013 |
| JP | 2017076848 | A | 4/2017 |
| WO | 2013190948 | A1 | 12/2013 |
| WO | 2015107797 | A1 | 7/2015 |

OTHER PUBLICATIONS

Written Opinion of the International Searching Authority issued for PCT/JP2017/018594, dated Jul. 18, 2017.

* cited by examiner

PRIOR ART

COIL ANTENNA

CROSS REFERENCE TO RELATED APPLICATIONS

The present application is a continuation of PCT/JP2017/018594 filed May 17, 2017, which claims priority to Japanese Patent Application No. 2016-112134, filed Jun. 3, 2016, the entire contents of each of which are incorporated herein by reference.

TECHNICAL FIELD

The present disclosure invention relates to a coil antenna in which a coil and a capacitor are incorporated, and more particularly, to a coil antenna in which a capacitor is not separated from a metal terminal or an electrode of a mounting substrate even when a root portion of a bobbin around which a coil is wound is bent by an external force.

BACKGROUND

Coil antennas incorporating coils and capacitors are widely used in a keyless entry system of an automobile, or the like.

Such a coil antenna is disclosed in Patent Document (Japanese Unexamined Patent Application Publication No. 2013-225947).

FIG. 8 illustrates a coil antenna (an antenna coil component) 1000 disclosed in Patent Document 1.

As shown, the coil antenna 1000 includes a bobbin 101 made of an insulating material. A rod-shaped magnetic core 102 is housed in the bobbin 101.

Moreover, a coil 103 is wound around an outer periphery of the bobbin 101 which houses the magnetic core 102. A winding direction of the coil 103 matches with a longitudinal direction of the bobbin 101 and the magnetic core 102.

At one end of the bobbin 101, a base 104 is provided which is made of an insulating material. In the coil antenna 1000, the bobbin 101 and the base 104 are integrally formed. However, there is also a case where the bobbin 101 and the base 104 are formed separately from each other, and then both of them are combined together.

From the base 104, a pair of metal terminals 105*a* and 105*b* are extended.

A chip-shaped capacitor 106 having outer electrodes formed at both ends thereof is mounted by solder so as to bridge the pair of metal terminals 105*a* and 105*b*.

The base 104 is further provided with a pair of harness terminals 107*a* and 107*b*. Lead wires (not illustrated) are connected to the harness terminals 107*a* and 107*b*, respectively.

Furthermore, the harness terminal 107*a* is connected to the metal terminal 105*a*, the metal terminal 105*b* is connected to one end of the coil 103, and the other end of the coil 103 is connected to the harness terminal 107*b*. As a result, in the coil antenna 1000, the capacitor 106 and the coil 103 are connected in series between the harness terminal 107*a* and the harness terminal 107*b*.

The coil antenna 1000 further includes a case 108 and a grommet 109.

Patent Document 1: Japanese Unexamined Patent Application Publication No. 2013-225947

The above-described coil antenna 1000 has a problem that when an external force such as an acceleration or the like is applied, the base 104 portion continuous with the bobbin 101, which is a root portion of the bobbin 101, is bent, and the capacitor 106 is separated from the metal terminals 105*a* and 105*b* by the stress (the solder is detached).

In particular, when the external force such as the acceleration or the like is applied to the coil antenna 1000, the base 104 portion which is continuous with the bobbin 101 is easy to be bent. In other words, the bobbin 101 itself houses the hard magnetic core 102 therein, and therefore hardly bends even if the external force is applied. Instead, the base 104 portion which is continuous with the bobbin 101 is easy to be bent. Further, the heavy magnetic core 102 housed in the bobbin 101 is also a cause of the base 104 portion being easy to be bent. In other words, since a rigidity of the base 104 portion is smaller than a rigidity of the bobbin 101 portion and the bobbin 101 portion has a heavy weight, when the external force is applied, the base 104 portion is easy to be bent.

When the base 104 portion is bent, a stress thereof is transmitted directly to the metal terminals 105*a* and 105*b*. That is, the metal terminal 105*a* and the metal terminal 105*b* are supported by the base 104 at different positions, respectively, in the winding direction of the coil 103 (in the longitudinal direction of the bobbin 101 and the magnetic core 102). More specifically, in the coil antenna 1000, the metal terminal 105*a* is supported by the base 104 at a portion far from the bobbin 101, and the metal terminal 105*b* is supported by the base 104 at a portion close to the bobbin 101. Therefore, when the base 104 portion is bent, the distance between the metal terminal 105*a* and the metal terminal 105*b* varies, the solder that fixes the capacitor 106 to the metal terminals 105*a* and 105*b* is detached, and the capacitor 106 is separated from the metal terminals 105*a* and 105*b* in some cases.

When the capacitor 106 is separated from the metal terminals 105*a* and 105*b*, the coil antenna 1000 does not function at all, resulting in a serious failure of the coil antenna.

SUMMARY OF THE INVENTION

The exemplary embodiments described herein have been made in order to solve the aforementioned existing problems. Thus, a coil antenna is disclosed that includes a bobbin; a coil wound around the bobbin; a capacitor connected to the coil; a base made of an insulating material which is attached to the bobbin or formed integrally with the bobbin; and a pair of metal terminals which is extended from the base or a mounting substrate having a plate shape with a pair of electrodes formed on a surface of the mounting substrate extended from the base or the bobbin, for mounting the capacitor, in which the pair of metal terminals or the mounting substrate is held in a cantilevered manner in a winding direction of the coil.

In addition, in the above configuration, the bobbin and the base may be manufactured as separate members, and the base may be attached to the bobbin. For example, an attachment hole for attaching the base to the bobbin may be provided, and the base may be inserted into the attachment hole and attached. In addition, in the above configuration, the base and the mounting substrate or the bobbin and the mounting substrate may be manufactured as separate members, the mounting substrate may be attached to the base or the bobbin. Specifically, for example, an attachment hole for attaching the mounting substrate to the base may be provided, and the mounting substrate may be inserted into the attachment hole and attached. For example, although a process of attaching an external terminal or mounting the capacitor to a large structure in which the bobbin, the base, and the mounting substrate are integrated is complicated in some cases, in a case the bobbin, the base, the mounting substrate, and the like are configured of separate members and attached to one another after a necessary process is completed, the manufacturing process of the coil antenna can be simplified and the productivity of the coil antenna can be improved. Further, in a case where the bobbin, the base, and the mounting substrate are made of a resin and have complicated shapes, although it is difficult to mold in some cases when these members are integrated, by these members being configured of separate members, the molding can be carried out with ease.

It is noted that in the present application, the electrode formed on the surface of the mounting substrate includes the metal terminal attached to the surface of the mounting substrate, as well as the film-shaped electrode formed on the surface of the mounting substrate. In the latter case, the attached metal terminal is referred to as an electrode.

Additionally, a coil antenna according to another exemplary aspect includes a bobbin; a coil wound around the bobbin; a capacitor connected to the coil; a base made of an insulating material which is attached to the bobbin or formed integrally with the bobbin; and a mounting substrate having a plate shape with a pair of electrodes formed on a surface of the mounting substrate extended from the base for mounting the capacitor, in which the mounting substrate is formed by providing an L-shaped slit in the base.

Preferably, a magnetic core is provided in the bobbin. In this case, it is possible to enhance the function of the coil.

In a coil antenna according to the exemplary embodiments of the present disclosure, even when a root portion of a bobbin around which a coil is wound is bent by an external force, a capacitor does not separate from a metal terminal or an electrode of a mounting substrate.

DETAILED DESCRIPTION OF EMBODIMENTS

Figures 1A, 1B, 1C:
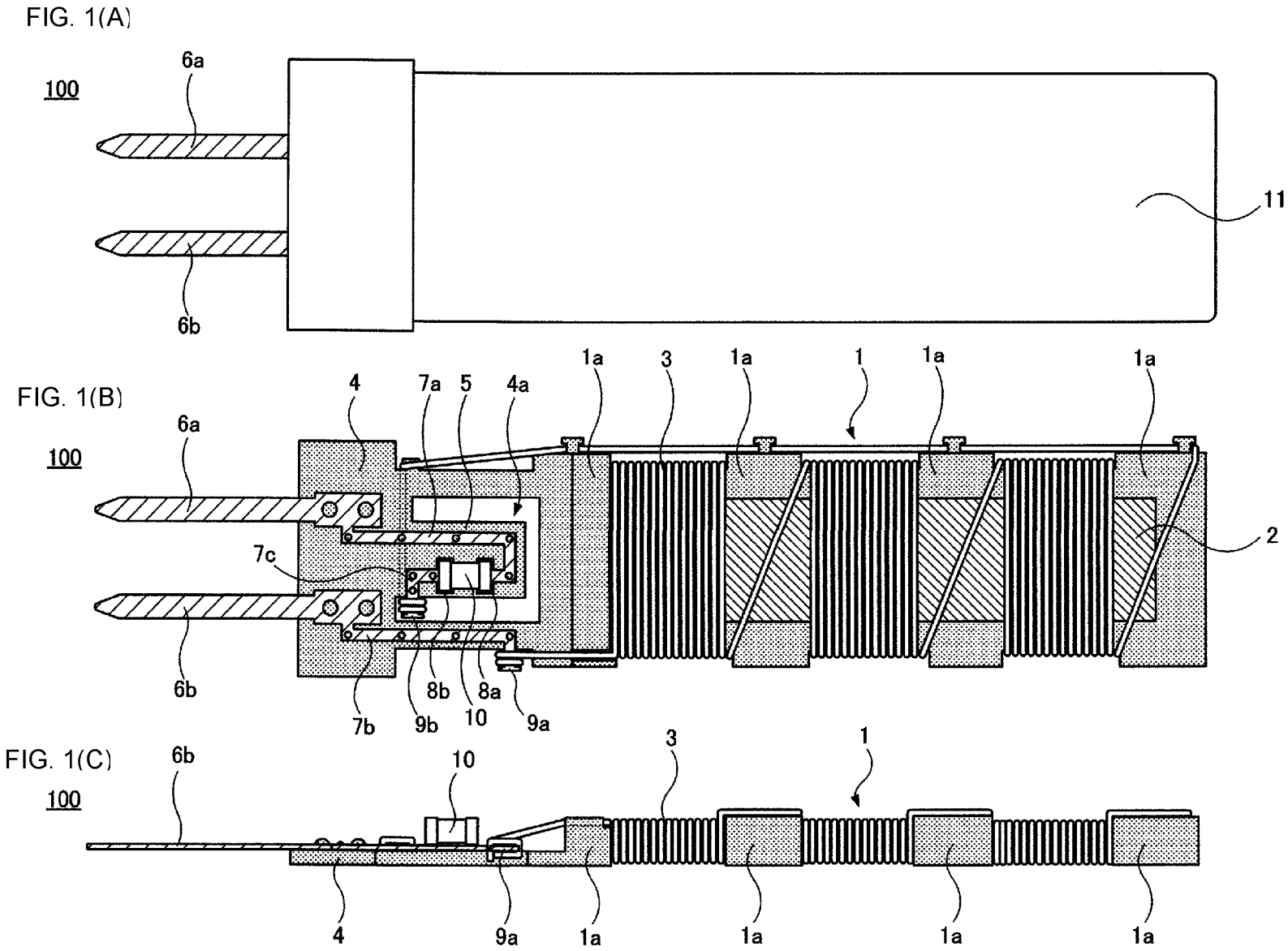
FIG. 1(A) is a plan view of a coil antenna 100 according to a first exemplary embodiment.
FIG. 1(B) is an exploded plan view of the coil antenna 100 in which a case 11 is omitted.
FIG. 1(C) is an exploded side view of the coil antenna 100 in which the case 11 is omitted.

Hereinafter, exemplary embodiments for carrying out the present invention will be described with reference to the drawings.

It should be noted that respective embodiments illustratively indicate the embodiments of the present invention and the present invention is not limited to contents of the embodiments. Additionally, contents described in different embodiments can also be combined and implemented and the present invention also encompasses the implementation contents in this case. Additionally, the drawings assist understanding of the embodiments and are not necessarily illustrated strictly in some cases. For example, ratios of dimensions of the illustrated constituent elements or ratios of dimensions among the constituent elements are not identical to ratios of dimensions thereof that are described in the specification in some cases. Furthermore, the constituent elements that are described in the specification are omitted in the drawings or illustrated without numbers of the constituted elements in some cases.

First Exemplary Embodiment

FIGS. 1(A) to 1(C) illustrate a coil antenna 100 according to a first embodiment. FIG. 1(A) is a plan view of the coil antenna 100. FIG. 1(B) is an exploded plan view of the coil antenna 100 in which a case 11 is omitted. FIG. 1(C) is an exploded side view of the coil antenna 100 in which the case 11 is omitted.

As shown, the coil antenna 100 includes a frame-shaped bobbin 1 made of a resin. In the present embodiment, four flange portions 1*a* are formed on the bobbin 1, although the number of flange portions is not so limited to a particular number.

A rod-shaped magnetic core 2 made of ferrite is housed and is fixed with an adhesive in the bobbin 1.

Moreover, a coil 3 is wound around an outer periphery of the bobbin 1 in which the magnetic core 2 is housed. The coil 3 is divided into three portions partitioned by the flange portion 1*a* and is wound. A winding direction of the coil 3 matches with a longitudinal direction of the bobbin 1 and the magnetic core 2.

At one end of the bobbin 1, a base 4 is provided integrally with the bobbin 1. Like the bobbin 1, the base 4 is made of a resin. In the present embodiment, the base 4 has a plate shape. However, the base 4 may have any shapes and structures and is not limited to have a plate shape. In addition, in the present embodiment, the bobbin 1 and the base 4 are integrally formed, but both of them may be formed as separate bodies and may be combined together.

In the base 4, a slit 4*a* having a substantially square shape with a left side open of Japanese Katakana (i.e., a shape similar to a C shape or a U shape of the alphabet) is formed, and a mounting substrate 5 is constituted by a portion surrounded by the slit 4*a*. In other words, in the present embodiment, the mounting substrate 5 is formed integrally with the base 4. The mounting substrate 5 is held in a cantilevered manner in the winding direction of the coil 3.

A pair of plate-shaped external terminals 6*a* and 6*b* for external connection are attached to the base 4. The external terminals 6*a* and 6*b* are manufactured through a punching process of a metal plate. The external terminals 6*a* and 6*b* each have attachment holes, and are attached to the base 4 by inserting projections provided on the base 4 through the attachment holes and melting and crushing tips of the projections.

A metal wiring 7*a* is formed integrally with the external terminal 6*a*, and an electrode 8*a* is further formed integrally with the metal wiring 7*a* at a tip of the metal wiring 7*a*. The electrode 8*a* is disposed on a surface of the mounting substrate 5. The metal wiring 7*a* also has attachment holes, and is attached to the base 4 and the mounting substrate 5 by inserting projections provided on the base 4 and the mounting substrate 5 through the attachment holes and melting and crushing tips of the projections.

A metal wiring 7*b* is formed integrally with the external terminal 6*b*, and a relay terminal 9*a* is further formed integrally with the metal wiring 7*b* at a tip of the metal wiring 7*b*. The relay terminal 9*a* is disposed so as to protrude from a side surface of the base 4. The metal wiring 7*b* also has attachment holes, and is attached to the base 4 by inserting projections provided on the base 4 through the attachment holes and melting and crushing tips of the projections.

Further, an electrode 8*b* is disposed on the surface of the mounting substrate 5. In addition, a metal wiring 7*c* is formed integrally with the electrode 8*b*, and a relay terminal 9*b* is further formed integrally with the metal wiring 7*c* at a tip of the metal wiring 7*c*. The relay terminal 9*b* is disposed so as to protrude into the slit 4*a*. The metal wiring 7*c* also has attachment holes, and is attached to the mounting substrate 5 by inserting projections provided on the mounting substrate 5 through the attachment holes and melting and crushing tips of the projections.

According to the exemplary aspect, a chip-shaped capacitor 10 having outer electrodes formed at both ends thereof is mounted on the electrodes 8*a* and 8*b* by solder.

Further, one end of the coil 3 is connected to the relay terminal 9*a* by solder. Additionally, the other end of the coil 3 is connected to the relay terminal 9*b* by solder.

As a result, in the coil antenna 100, the capacitor 10 and the coil 3 are connected in series between the external terminal 6*a* and the external terminal 6*b*.

The hollow-shaped case 11, which is made of an insulating material and opened at one end, is attached so as to cover the bobbin 1, the base 4, and the like.

The coil antenna 100 having the above structure can be manufactured, for example, by the following method.

First, a resin is molded to integrally manufacture the bobbin 1, the base 4, and the mounting substrate 5.

Further, a metal plate is punched out, and the external terminal 6*a*, the metal wiring 7*a*, and the electrode 8*a* are integrally manufactured. In the same manner, the external terminal 6*b*, the metal wiring 7*b*, and the relay terminal 9*a* are integrally manufactured. In the same manner, the electrode 8*b*, the metal wiring 7*c*, and the relay terminal 9*b* are integrally manufactured.

Next, the external terminal 6*a*, the metal wiring 7*a* and the electrode 8*a* which are integrally formed, the external terminal 6*b*, the metal wiring 7*b* and the relay terminal 9*a* which are integrally formed, and the electrode 8*b*, the metal wiring 7*c* and the relay terminal 9*b* which are integrally formed are each attached on the base 4 and the mounting substrate 5.

Then, the magnetic core 2 is housed in the bobbin 1, and is fixed by an adhesive or by being press-fitted.

Next, the coil 3 is wound around the outer periphery of the bobbin 1. Then, the one end of the coil 3 is connected to the relay terminal 9*a* through soldering, and the other end of the coil 3 is connected to the relay terminal 9*b* through soldering.

Next, the capacitor 10 is mounted on the electrodes 8*a* and 8*b*. For example, the mounting is carried out by reflow processing of a cream solder applied on the electrodes 8*a* and 8*b*.

Finally, the case 11 is attached so as to cover the bobbin 1, the base 4, and the like, thereby completing the coil antenna 100.

In the coil antenna 100 according to the present embodiment, since the mounting substrate 5 on which the electrodes 8*a* and 8*b* are provided and the capacitor 10 is mounted is held in the cantilevered manner in the winding direction of the coil 3, even if the base 4 continuous with the bobbin 1 is bent due to an external force such as acceleration or the like, the electrodes 8*a* and 8*b* and the capacitor 10 are not affected by a stress caused by the bending. Accordingly, the capacitor 10 does not separate from the electrodes 8*a* and 8*b*.

In order to confirm the advantageous effect, the following experiment was conducted.

Figure 2A:
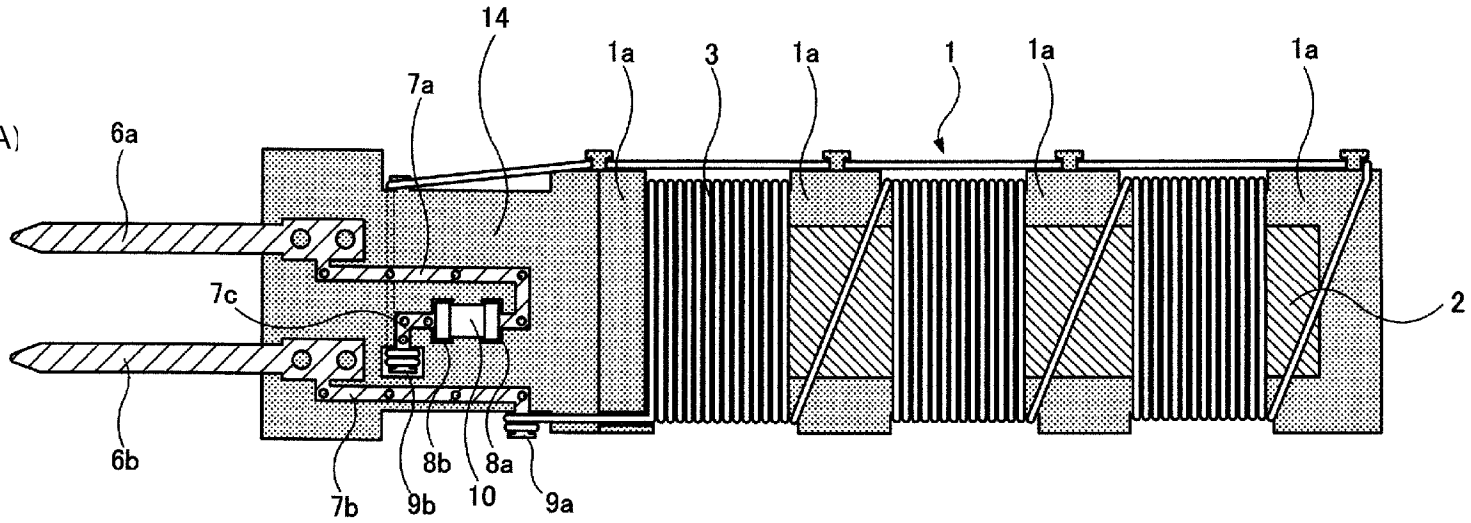
FIG. 2(A) is an exploded plan view of a coil antenna 1100 in which the case 11 is omitted according to a comparative example.
Figure 2B:
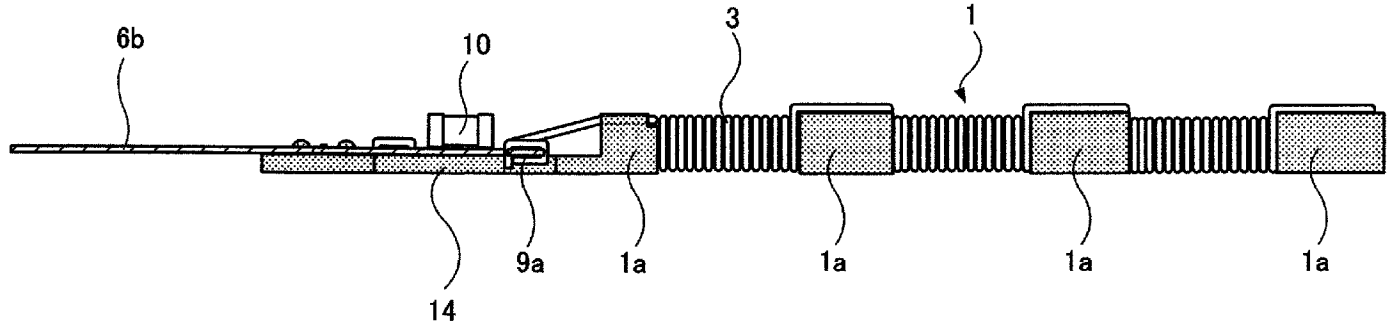
FIG. 2(B) is an exploded side view of the coil antenna 1100 in which the case 11 is omitted.

First, the coil antenna 100 according to the first embodiment was manufactured. Additionally, for comparison, a coil antenna 1100 according to a comparative example illustrated in FIGS. 2(A) and 2(B) was manufactured. It is noted that FIG. 2(A) is an exploded plan view of the coil antenna 1100 in which the case 11 is omitted. FIG. 2(B) is an exploded side view of the coil antenna 1100 in which the case 11 is omitted.

The coil antenna 1100 was obtained by changing a part of the coil antenna 100. Hereinafter, changes of the coil antenna 1100 from the coil antenna 100 will be described.

In the coil antenna 100, by forming the slit 4*a* having the substantially square shape with a left side open in the base 4, the mounting substrate 5 is formed. The mounting substrate 5 is held in the cantilevered manner from the base 4 in the winding direction of the coil 3, such that at least one open edge of the mounting substrate is formed by and adjacent to the opening formed by the slit 4*a*.

In contrast, in the coil antenna 1100, no slit was formed in a base 14. Therefore, the coil antenna 1100 does not include the mounting substrate, and the electrodes 8*a* and 8*b* are formed on a surface of the base 14 instead. Additionally, the capacitor 10 is mounted on the electrodes 8*a* and 8*b*.

Figure 3A:
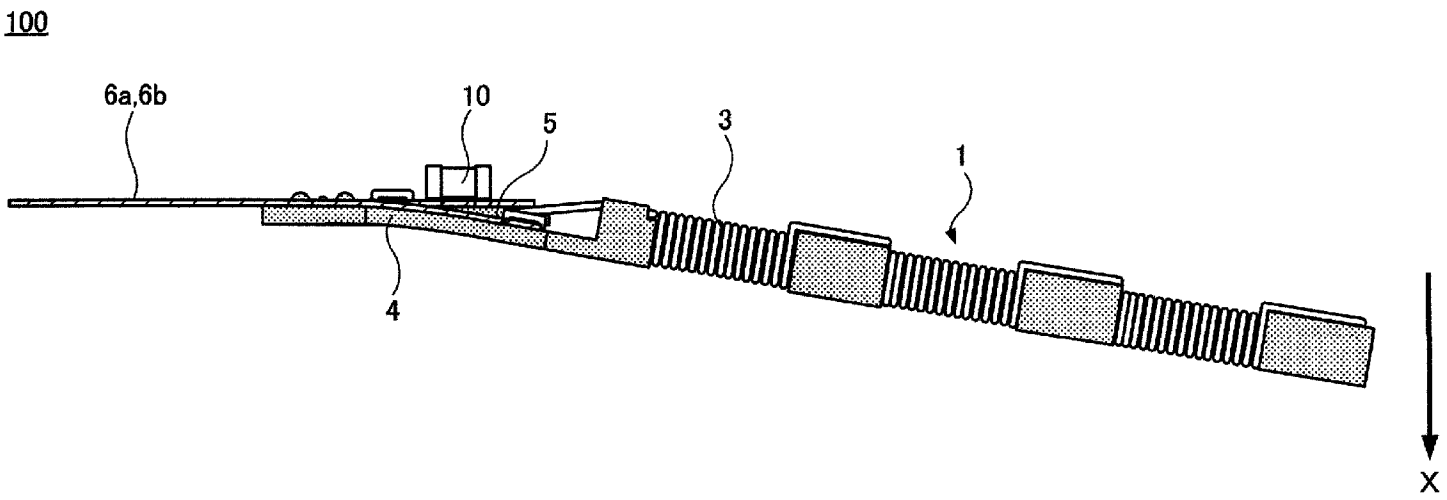
FIG. 3(A) is an exploded side view illustrating a state in which force is applied to a bobbin 1 of the coil antenna 100 according to the first exemplary embodiment in a direction indicated by an arrow X in an experiment.

Next, as illustrated in FIG. 3(A), the external terminals 6*a* and 6*b* of the coil antenna 100 were fixed, and then the bobbin 1 of the coil antenna 100 was bent in a direction indicated by an arrow X (downward direction). As a result, in the coil antenna 100, the base 4 was bent, but the mounting substrate 5 was not affected by the bending, and was not bent. Accordingly, in the coil antenna 100, the capacitor 10 was not separated from the electrodes 8*a* and 8*b* due to the detachment of the solder.

Figure 3B:
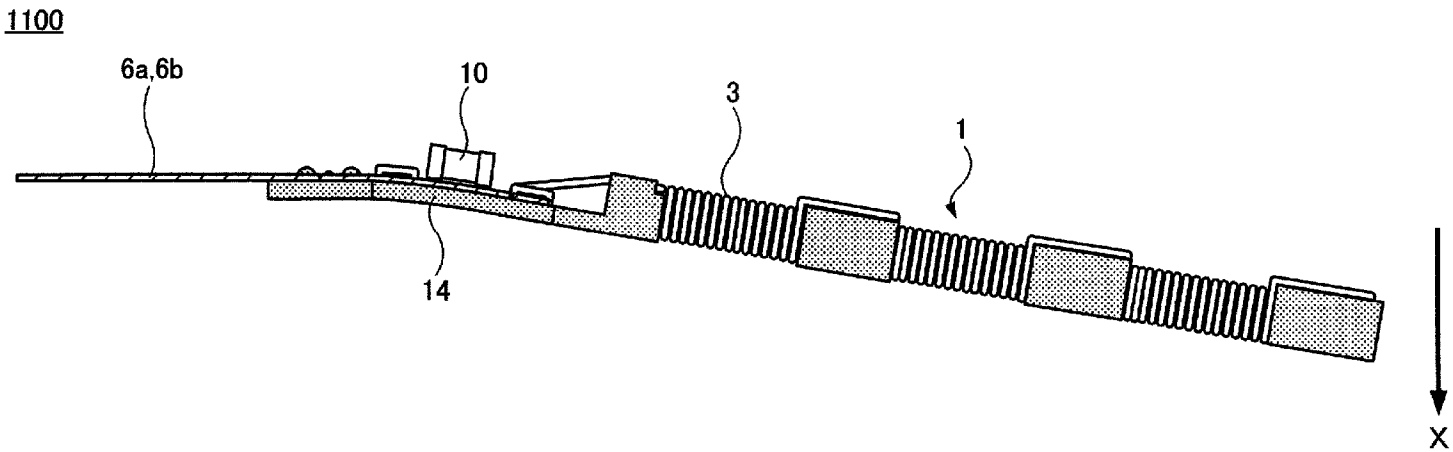
FIG. 3(B) is an exploded side view illustrating a state in which force is applied to the bobbin 1 of the coil antenna 1100 according to the comparative example in a direction indicated by an arrow X in an experiment.

Next, as illustrated in FIG. 3(B), the external terminals 6*a* and 6*b* of the coil antenna 1100 were fixed, and then the bobbin 1 of the coil antenna 1100 was bent in a direction indicated by an arrow X (downward direction). As a result, in the coil antenna 1100, the base 14 of a portion on which the capacitor 10 was mounted was bent. Additionally, when the coil antenna 1100 was bent by a certain amount or more in the direction of the arrow X with respect to the bobbin 1, the solder was detached and the capacitor 10 was separated from the electrodes 8*a* and/or 8*b*.

As described above, it was found that, as in the coil antenna 100 according to the present embodiment, by providing the mounting substrate 5 having the electrodes 8*a* and 8*b* for mounting the capacitor 10 formed on the surface thereof and holding the mounting substrate 5 in the cantilevered manner from the base 4 in the winding direction of the coil 3, even if the base 4 was bent due to the external force or the like, the electrodes 8*a* and 8*b* and the capacitor 10 were not affected by the bending, and the capacitor 10 was not separated from the electrodes 8*a* and 8*b*.

Second Exemplary Embodiment

Figure 4:
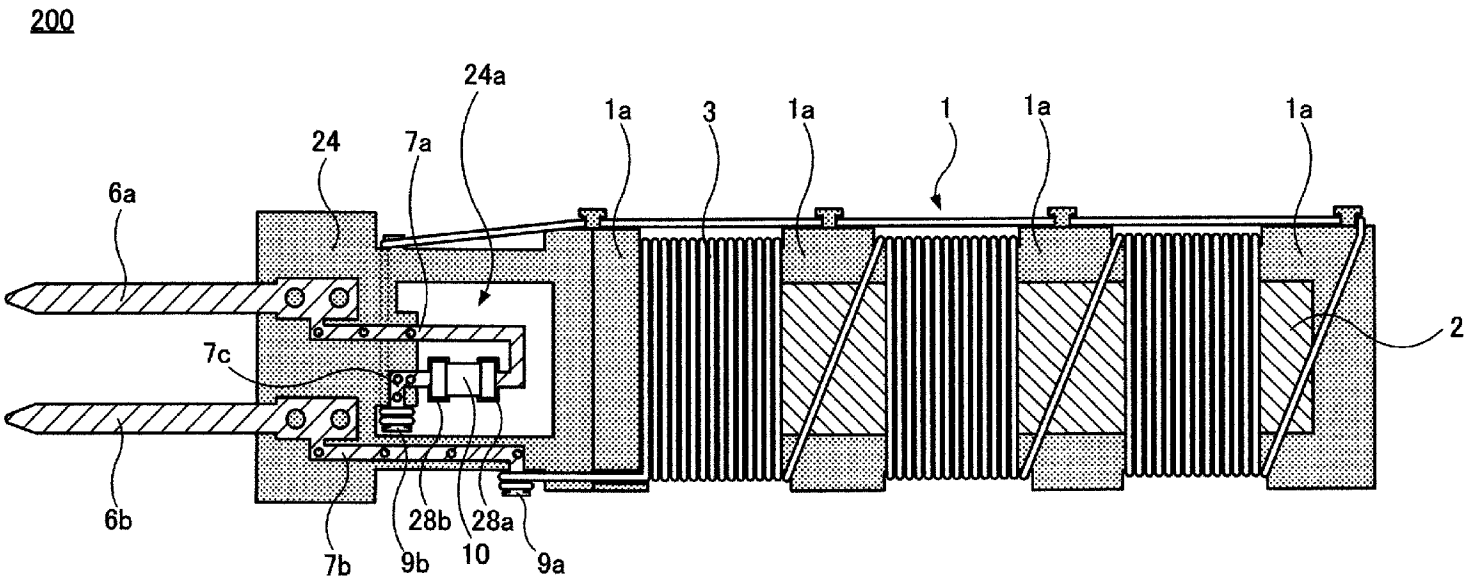
FIG. 4 is an exploded plan view of a coil antenna 200 in which the case 11 is omitted according to a second exemplary embodiment.

FIG. 4 illustrates a coil antenna 200 according to a second embodiment. FIG. 4 is an exploded plan view of the coil antenna 200 in which the case 11 is omitted.

The coil antenna 200 is obtained by changing a part of the coil antenna 100 according to the first embodiment. Hereinafter, changes of the coil antenna 200 from the coil antenna 100 will be described.

In the coil antenna 100, by forming the slit 4*a* having the substantially square shape with a left side open in the base 4, the mounting substrate 5 is formed. Additionally, on the surface of the mounting substrate 5 which is held in the cantilevered manner from the base 4 in the winding direction of the coil 3, the electrodes 8*a* and 8*b* are formed.

In contrast, in the coil antenna 200, no slit is formed in a base 24, an opening 24*a* having a substantially rectangular shape is provided instead. As a result, in the coil antenna 200, a portion which is formed integrally with the metal wiring 7*a* and continuous with the metal wiring 7*a* is disposed in a hollow portion of the opening 24*a* as a metal terminal 28*a*. In the same manner, a portion which is formed integrally with the metal wiring 7*c* and continuous with the metal wiring 7*c* is disposed in the hollow portion of the opening 24*a* as a metal terminal 28*b*.

Additionally, in the coil antenna 200, the capacitor 10 is mounted on the metal terminals 28*a* and 28*b* disposed in the hollow portion of the opening 24*a*. Other configurations of the coil antenna 200 are the same as those of the coil antenna 100.

In the coil antenna 200 according to the second embodiment as well, even if the base 24 continuous with the bobbin 1 is bent due to the external force such as the acceleration or the like, the metal terminals 28*a* and 28*b* and the capacitor 10 are not affected by the stress due to the bending, and the capacitor 10 is not separated from the metal terminals 28*a* and 28*b*.

Third Exemplary Embodiment

Figure 5:
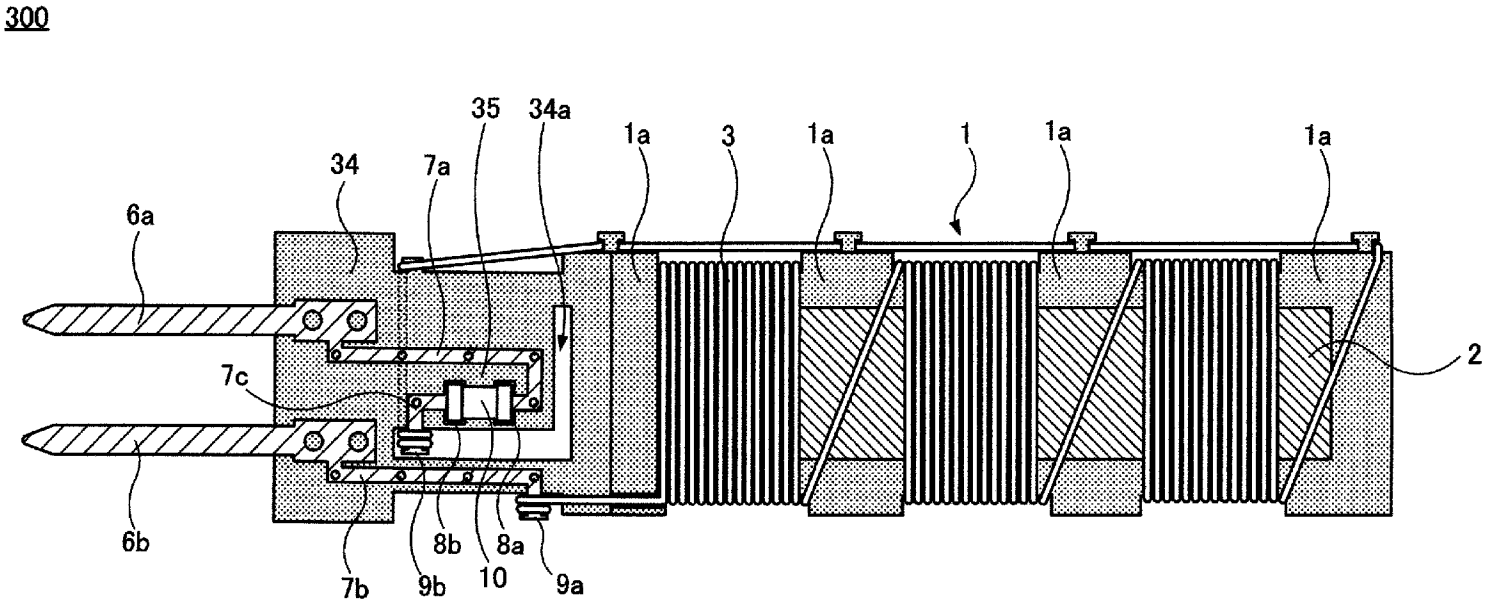
FIG. 5 is an exploded plan view of a coil antenna 300 in which the case 11 is omitted according to a third exemplary embodiment.

FIG. 5 illustrates a coil antenna 300 according to a third embodiment. FIG. 5 is an exploded plan view of the coil antenna 300 in which the case 11 is omitted.

The coil antenna 300 is obtained by changing a part of the coil antenna 100 according to the first embodiment. Hereinafter, changes of the coil antenna 300 from the coil antenna 100 will be described.

In the coil antenna 100, by forming the slit 4*a* having the substantially square shape with a left side open in the base 4, the mounting substrate 5 is formed. Additionally, on the surface of the mounting substrate 5 which is held in the cantilevered manner from the base 4 in the winding direction of the coil 3, the electrodes 8*a* and 8*b* are formed.

In contrast, in the coil antenna 300, by forming a slit 34*a* having an L-shape in a base 34, a mounting substrate 35 is formed. The mounting substrate 35 is supported by remaining two sides on the opposite side of the slit 34*a*, from the base 34. Additionally, in the coil antenna 300 as well, the capacitor 10 is mounted on the electrodes 8*a* and 8*b* formed on a surface of the mounting substrate 35. Other configurations of the coil antenna 300 are the same as those of the coil antenna 100.

In the coil antenna 300 according to the third embodiment as well, in a case where the base 34 continuous with the bobbin 1 is bent due to the external force such as the acceleration or the like, the influence of a stress due to the bending received by the electrodes 8*a*, 8*b* and the capacitor 10 can be reduced, and thus the capacitor 10 can be suppressed from being separated from the electrodes 8*a* and/or 8*b*. Note that the advantageous effect for suppressing the capacitor 10 from being separated from the electrodes 8*a* and 8*b* in the coil antenna 300 is considered to be lower than that in the coil antenna 100.

Fourth Exemplary Embodiment

Figure 6A:
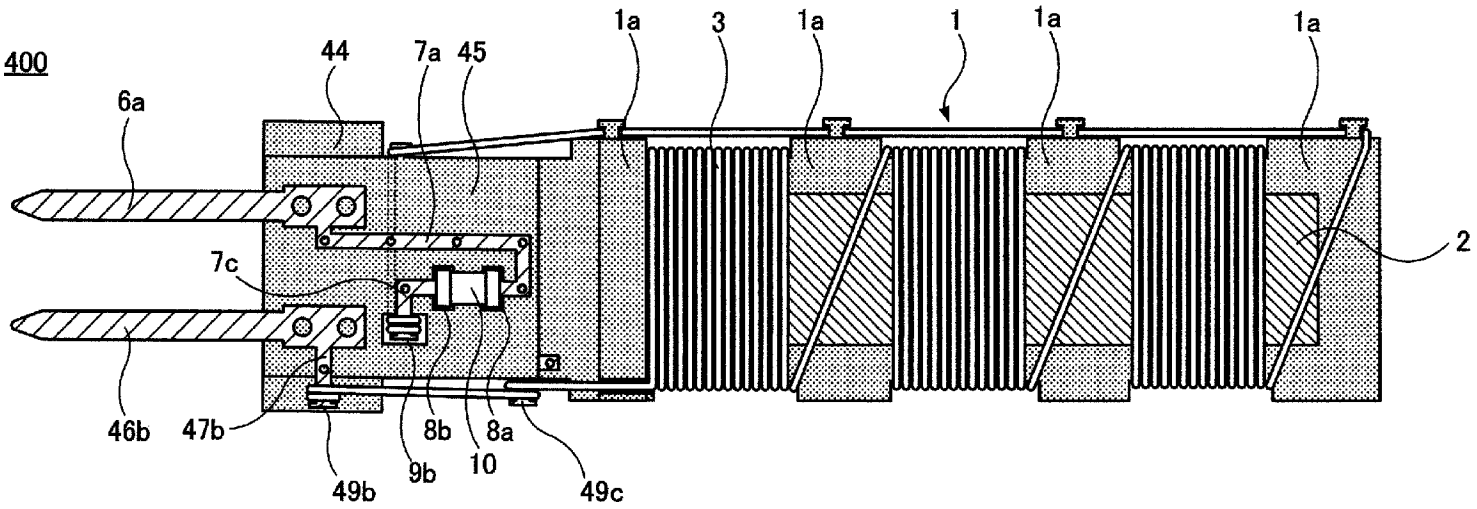
FIG. 6(A) is an exploded plan view of a coil antenna 400 in which the case 11 is omitted according to a fourth exemplary embodiment.
Figure 6B:
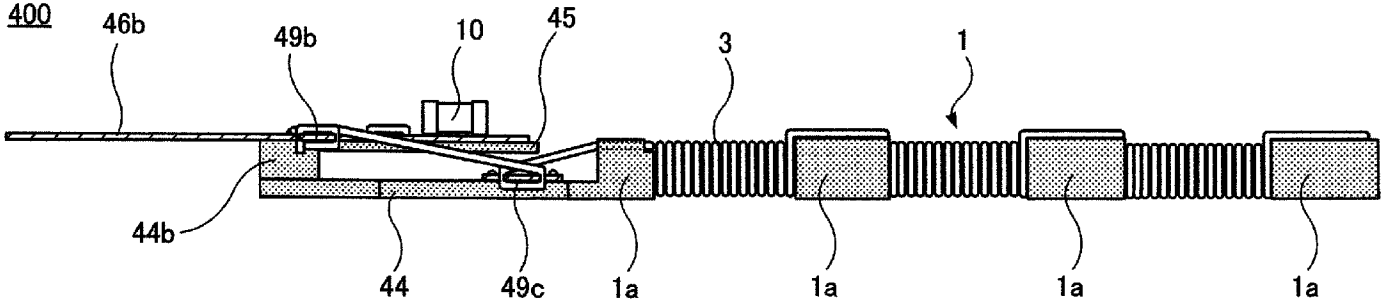
FIG. 6(B) is an exploded side view of the coil antenna 400 in which the case 11 is omitted.

FIGS. 6(A) and 6(B) illustrate a coil antenna 400 according to a fourth embodiment. FIG. 6(A) is an exploded plan view of the coil antenna 400 in which the case 11 is omitted. FIG. 6(B) is an exploded side view of the coil antenna 400 in which the case 11 is omitted.

The coil antenna 400 is obtained by changing a part of the coil antenna 100 according to the first embodiment. Hereinafter, changes of the coil antenna 400 from the coil antenna 100 will be described.

In the coil antenna 100, by forming the slit 4*a* having the substantially square shape with a left side open in the base 4, the mounting substrate 5 is formed. Additionally, on the surface of the mounting substrate 5 which is held in the cantilevered manner from the base 4 in the winding direction of the coil 3, the electrodes 8*a* and 8*b* are formed.

In contrast, in the coil antenna 400, instead of forming the slit, above a base 44 with a constant space from the base 44, a substantially rectangular mounting substrate 45 supported by the base 44 is provided. In other words, the mounting substrate 45 is formed integrally with the projection 44*b*, so as to be continuous from a projection 44*b* provided on the base 44. The mounting substrate 45 is also held in the cantilevered manner from the base 44 in the winding direction of the coil 3.

Additionally, in the coil antenna 400, the external terminal 6*a*, the metal wiring 7*a* and the electrode 8*a* which are integrally formed, and the electrode 8*b*, the metal wiring 7*c* and the relay terminal 9*b* which are integrally formed are each attached on the mounting substrate 45. In addition, by slightly changing a shape of the external terminal 6*b*, the metal wiring 7*b* and the relay terminal 9*a* which are integrally formed of the coil antenna 100, an external terminal 46*b*, a metal wiring 47*b* and a relay terminal 49*b* which are integrally formed are manufactured, and attached on the mounting substrate 45 in the same manner. Further, in the coil antenna 400, a new relay terminal 49*c* is additionally provided on a side surface of the base 44 in order to connect the one end of the coil 3 to the relay terminal 49*b*.

Additionally, in the coil antenna 400 as well, the capacitor 10 is mounted on the electrodes 8*a* and 8*b* provided on a surface of the mounting substrate 45. Other configurations of the coil antenna 400 are the same as those of the coil antenna 100 and will not be repeated herein.

In the coil antenna 400 according to the fourth embodiment as well, even if the base 44 continuous with the bobbin 1 is bent due to the external force such as the acceleration or the like, the electrodes 8*a* and 8*b* and the capacitor 10 are not affected by the stress due to the bending, and the capacitor 10 is not separated from the electrodes 8*a* and/or 8*b*.

Fifth Exemplary Embodiment

Figure 7A:
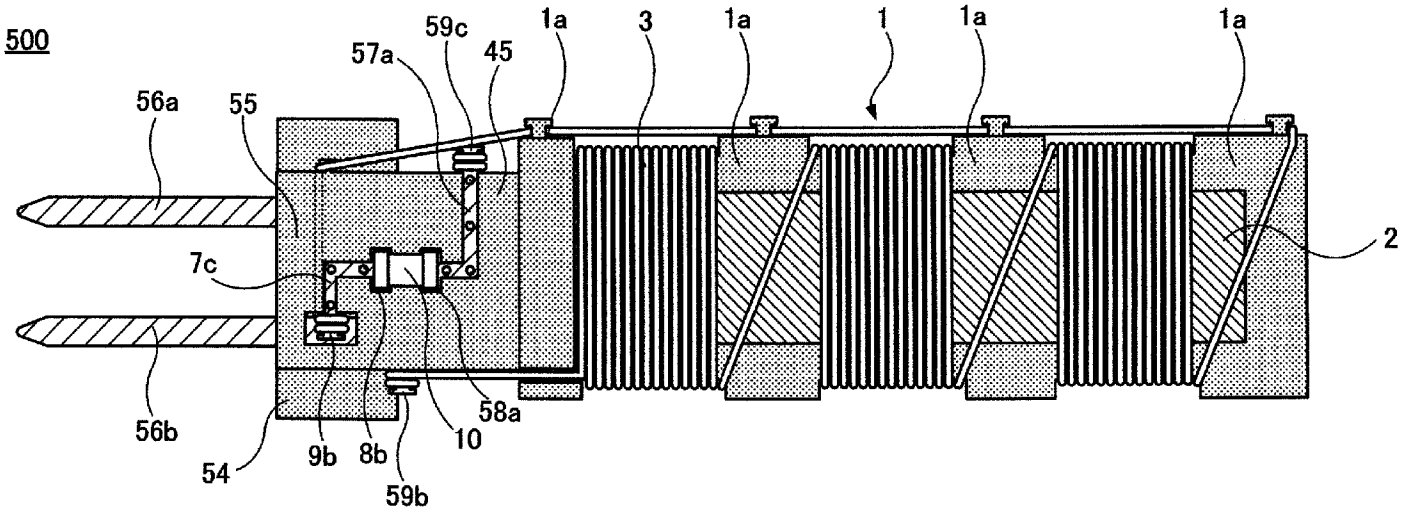
FIG. 7(A) is an exploded plan view of a coil antenna 500 in which the case 11 is omitted according to a fifth exemplary embodiment.
Figure 7B:
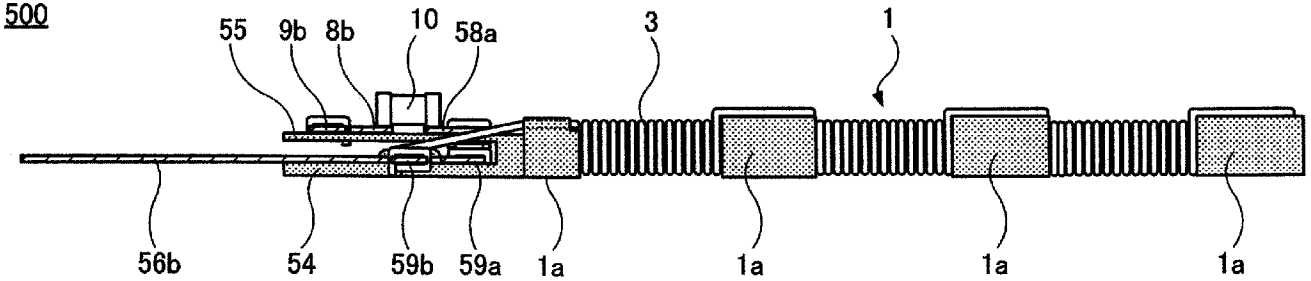
FIG. 7(B) is an exploded side view of the coil antenna 500 in which the case 11 is omitted.
Figure 8:
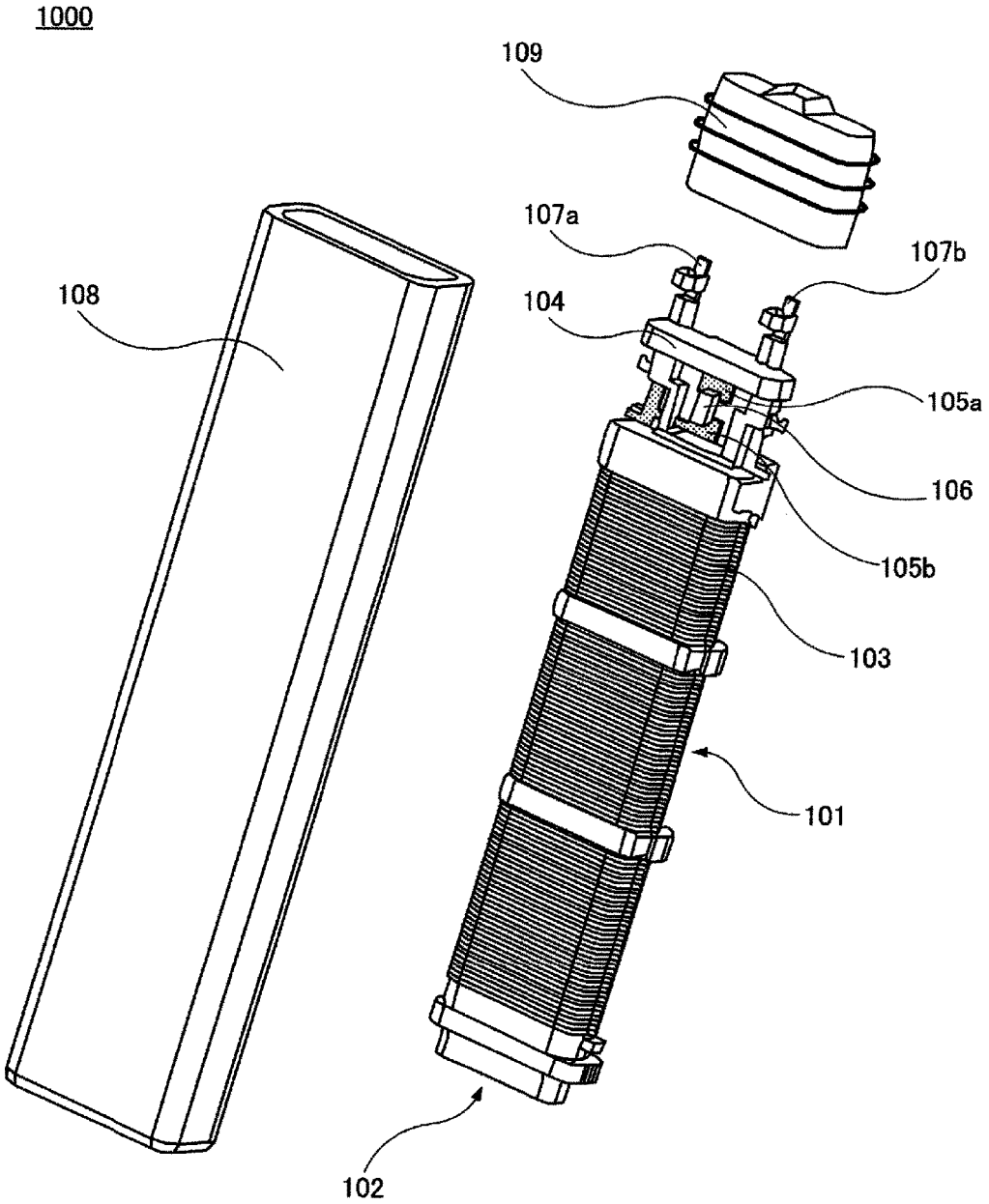
FIG. 8 is an exploded perspective view illustrating a coil antenna 1000 disclosed in Patent Document 1.

FIGS. 7(A) and 7(B) illustrate a coil antenna 500 according to a fifth embodiment. FIG. 7(A) is an exploded plan view of the coil antenna 500 in which the case 11 is omitted. FIG. 7(B) is an exploded side view of the coil antenna 500 in which the case 11 is omitted.

In the coil antenna 500 according to the fifth embodiment, a direction in which a mounting substrate 55 is held in the cantilevered manner from a base 54 is changed. In other words, in the coil antennas 100 to 400 according to the first embodiment to the fourth embodiment, the mounting substrates 5, 35 and 45, and the metal terminals 28*a* and 28*b* are held in the cantilevered manner facing the direction in which the bobbin 1 is present. In contrast, in the coil antenna 500, the mounting substrate 55 is held in the cantilevered manner from the base 54 facing not the direction in which the bobbin 1 is present, but the direction in which external terminals 56*a* and 56*b* are present (the direction in which the external terminals 56*a* and 56*b* extend).

With this change, in the coil antenna 500, the external terminals 56*a* and 56*b* each having a new shape are manufactured and attached on the base 54. At another end of the external terminal 56*a*, a relay terminal 59*a* is integrally formed with a metal wiring (not illustrated) interposed therebetween. At another end of the external terminal 56*b*, a relay terminal 59*b* is integrally formed with a metal wiring (not illustrated) interposed therebetween.

In addition, in the coil antenna 500, an electrode 58*a*, a metal wiring 57*a* and a relay terminal 59*c* which are integrally formed with a new shape are manufactured and attached on the mounting substrate 55. Then, the relay terminal 59*c* and the relay terminal 59*a* are connected to each other. It is noted that the electrode 8*b*, the metal wiring 7*c* and the relay terminal 9*b* which are integrally formed and used in the coil antenna 100 according to the first embodiment or the like are used in the shape as they are for the other electrode which is paired with the electrode 58*a*, and attached on the mounting substrate 55.

In the coil antenna 500, the one end of the coil 3 is connected to the relay terminal 59*b*, and the other end of the coil 3 is connected to the relay terminal 9*b*. Additionally, the capacitor 10 is mounted on the electrodes 58*a* and 8*b*.

In the coil antenna 500 according to the fifth embodiment, in a case where the base 54 continuous with the bobbin 1 is bent due to the external force such as the acceleration or the like, the mounting substrate 55 follows the movement of the bobbin 1. However, since the mounting substrate 55, the electrodes 58*a* and 8*b*, and the capacitor 10 are not affected by the bending due to the space formed between the mounting substrate 55 and the base 54, the capacitor 10 does not separate from the electrodes 58*a* and/or 8*b*.

Variation on Fifth Embodiment

In the coil antenna 500 according to the fifth embodiment, the mounting substrate 55 is held in the cantilevered manner by the base 54. In a coil antenna according to a variation on the fifth embodiment (not illustrated), instead of holding the mounting substrate 55 in the cantilevered manner by the base 54, the mounting substrate 55 is held in the cantilevered manner by the bobbin 1. In such a variation as well, it is possible to obtain the same advantageous effect as that of the coil antenna 500.

As described above, the coil antennas 100 to 500 according to the first embodiment to the fifth embodiment have been illustrated. However, the present invention is not limited to the contents described above, and various changes can be made following the gist of the invention.

For example, in the coil antennas 100 to 500 according to the first embodiment to the fifth embodiment, although the bases 4, 24, 34, 44, and 54 are each manufactured integrally with the bobbin 1, the base and the bobbin may be manufactured as separate members, and both the members may be combined together later.

Additionally, although, in the coil antennas 100, 300, 400, and 500 according to the first embodiment, the third embodiment, the fourth embodiment, and the fifth embodiment, the base 4 and the mounting substrate 5, the base 34 and the mounting substrate 35, the base 44 and the mounting substrate 45, and the base 54 and the mounting substrate 55 are integrally formed, respectively, the base and the mounting substrate in each case may be manufactured as separate members, and both of the members may be combined together later.

Additionally, in the coil antennas 100, 300, and 400 according to the first embodiment, the third embodiment, and the fourth embodiment, although the electrodes 8*a* and 8*b* formed by punching a metal plate are attached on each of the surfaces of the mounting substrates 5, 35, and 45, an electrode made of a film-shaped metal may be formed on each of the surfaces of the mounting substrates 5, 35, and 45 instead.

Further, in the coil antennas 100 to 300 according to the first embodiment to the third embodiment, the external terminals 6*a* and 6*b* are attached to each of the bases 4, 24, and 34. Additionally, in the coil antenna 400 according to the fourth embodiment, the external terminals 6*a* and 46*b* are attached to the mounting substrate 45. By changing this configuration, a harness terminal may be attached to each of the bases 4, 24, 34 and the mounting substrate 45 instead of the external terminals 6*a*, 6*b*, and 46*b*, and a lead wire may be connected to the harness terminal.

REFERENCE SIGNS LIST

1 BOBBIN
1*a* FLANGE PORTION
2 MAGNETIC CORE (MADE OF FERRITE)
3 COIL
4, 24, 34, 44, 54 BASE
4*a*, 34*a* SLIT
24*a* OPENING
44*b* PROJECTION
5, 35, 45, 55 MOUNTING SUBSTRATE
6*a*, 6*b*, 46*b*, 56*a*, 56*b* EXTERNAL TERMINAL
7*a*, 7*b*, 7*c*, 47*b*, 57*a* METAL WIRING
8*a*, 8*b*, 58*a* ELECTRODE
28*a*, 28*b* METAL TERMINAL
9*a*, 9*b*, 49*b*, 49*c*, 59*a*, 59*b* RELAY TERMINAL
10 CAPACITOR (CHIP-SHAPED CAPACITOR)
11 CASE
100, 200, 300, 400, 500 COIL ANTENNA

The invention claimed is:

1. A coil antenna comprising:

a bobbin;

a coil wound around the bobbin;

a base comprising an insulating material and coupled to or integrally formed with the bobbin;

a mounting substrate having a plate shape with a pair of electrodes disposed on a surface of the mounting substrate; and a capacitor mounted to the pair of electrodes and electrically connected to the coil, wherein the mounting substrate extends from the base and has at least one open edge that is not coupled to either the base or the bobbin, and wherein the base comprises an L-shaped slit disposed therein, such that the L-shape slit surrounds the at least one open edge of the mounting substrate.

2. The coil antenna according to claim 1, further comprising a magnetic core disposed in the bobbin.

3. The coil antenna according to claim 1, wherein the base is a separate component from the mounting substrate with the mounting substrate attached to the base.

4. The coil antenna according to claim 1, wherein the bobbin is a separate component from the mounting substrate with the mounting substrate attached to the bobbin.

5. The coil antenna according to claim 1, wherein the mounting substrate is held in a cantilevered configuration in a winding direction of the coil.

6. The coil antenna according to claim 5, wherein the base comprises an opening with the mounting substrate disposed in the opening and extending towards the bobbin.

7. The coil antenna according to claim 6, wherein the opening comprises one of a C shape or a U shape that surrounds the mounting substrate, with one edge of the mounting substrate coupled to the base.

8. The coil antenna according to claim 1, wherein the mounting substrate is coupled to the base by a projection extending from a surface of the base, such that a space is formed between the capacitor and the base in a thickness direction of the coil antenna.

9. The coil antenna according to claim 1, wherein the mounting substrate extends from the base in a direction opposite the bobbin with a space formed between the capacitor and the base in a thickness direction of the coil antenna.

10. The coil antenna according to claim 1, wherein the mounting substrate extends from the base in a cantilevered configuration that prevents the capacitor from separating from the pair of electrodes when the bobbin is bent relative to the base.

11. A coil antenna comprising:

a bobbin;

a coil wound around the bobbin;

a base comprising an insulating material and coupled to or integrally formed with the bobbin;

a mounting substrate having a plate shape with a pair of electrodes disposed on a surface of the mounting substrate; and a capacitor mounted to the pair of electrodes and electrically connected to the coil, wherein the mounting substrate is structurally configured relative to the base in a configuration that prevents the capacitor from separating from the pair of electrodes when the bobbin is bent relative to the base, wherein the mounting substrate is held in a cantilevered configuration in a winding direction of the coil, and wherein the base comprise an opening with the mounting substrate disposed in the opening and extending towards the bobbin.

12. The coil antenna according to claim 11, wherein the opening comprises one of a C shape or a U shape that surrounds the mounting substrate, with one edge of the mounting substrate coupled to the base.

* * * * *